US005277684A

United States Patent [19]

Harris

[11] Patent Number: 5,277,684

[45] Date of Patent: Jan. 11, 1994

[54] MULTI-FUNCTION EXERCISE APPARATUS

[76] Inventor: Robert W. Harris, 3204 Coachman's Way, Durham, N.C. 27705

[21] Appl. No.: 954,307

[22] Filed: Sep. 30, 1992

[51] Int. Cl.[5] ..... A63B 21/04

[52] U.S. Cl. ..... 482/130; 482/121; 482/123; 482/137; 482/908

[58] Field of Search ..... 482/121, 123, 129, 130, 482/138, 139, 142, 148, 97-100; 128/25R 25B 25C

[56] References Cited

U.S. PATENT DOCUMENTS

| | | | |
|---|---|---|---|
| 2,855,199 | 10/1958 | Noland et al. . | |
| 3,976,058 | 8/1976 | Tidwell | 482/130 |
| 4,072,309 | 2/1978 | Wilson . | |
| 4,502,681 | 3/1985 | Blomquist | 482/130 |
| 4,566,691 | 1/1986 | Mahnke . | |
| 4,582,320 | 4/1986 | Shaw . | |
| 4,600,189 | 7/1986 | Olschansky et al. | 482/100 |
| 4,627,619 | 12/1986 | Rockwell et al. . | |
| 4,666,149 | 5/1987 | Olschansky et al. | 482/130 |
| 4,850,586 | 7/1989 | Horvath . | |
| 4,854,578 | 8/1989 | Fulks . | |
| 4,979,736 | 12/1990 | Maynard . | |
| 5,002,271 | 3/1991 | Gonzales | 482/130 |
| 5,066,004 | 11/1991 | Jones . | |

OTHER PUBLICATIONS

Home Fitness Magazine, DP Chairman exercise machine, vol. 1, p. 82 (1992).

*Primary Examiner*—Richard J. Apley
*Assistant Examiner*—Jeanne M. Mollo
*Attorney, Agent, or Firm*—Richard E. Jenkins

[57] ABSTRACT

A multi-function exercise apparatus has a base frame including two vertical support members. An adjustable support means is secured to the frame and provides support for a user in a plurality of different upright and horizontal exercise positions. A lever arm is mounted to a fixed shaft extending from each of the two support members, and an elastic band biasing means cooperatively engages each lever arm and corresponding support member thereof so that each lever arm is adapted to have its forward or rearward rotational bias changed without requiring removal and relocation of the lever arm, the corresponding elastic bands, or the corresponding band support pins.

7 Claims, 7 Drawing Sheets

MULTI-FUNCTION EXERCISE APPARATUS

DESCRIPTION

1. Technical Field

The present invention relates to a multi-function exercise apparatus which is adapted to work selected muscle groups against the force of elastic bands. More particularly, the apparatus provides a dual independent lever arm machine wherein each lever arm can have its biased direction of rotation changed by retraction of a single biasing pin without requiring removal and relocation of the lever arm, the corresponding elastic band(s), or the band support pins.

2. Related Art

In recent years the value of staying trim and fit through the use of exercise machines has become well recognized. This desire by both men and women for physical fitness has resulted in the availability of members-only health clubs which typically provide a variety of exercise machines whereupon one or two specific exercises are performed on each machine to exercise specific muscles.

One of the very early and popular series of machines of this type is sold under the trademark NAUTILUS. These exercise machines, as is well known to those skilled in this art, permit exercising of a desired muscle group against a progressive resisting force which is determined by adding (or removing) weights to the machine other similar types of exercise apparatus utilizing a plurality of different machines to exercise different muscle groups include such well-known competitive equipment as PARAMOUNT machines which are quite similar in construction to the NAUTILUS machines.

In view of the popularity of the exercise machines provided at health clubs, more recently a series of exercise machines have been made available for home use. However, in view of cost and space limitations, the home exercise machines have by necessity generally had to be multi-purpose singular units. Most of the conventional multi-purpose exercise machines designed for use in the home have, unfortunately, suffered from shortcomings with respect to size, cost and/or complexity so as to limit their appeal to the average person.

Representative examples of exercise machines that could be adapted for use in the home include the exercise machine disclosed in Noland et al. U.S. Pat. No. 2,855,199. This apparatus comprises a lever arm and resistance arm which are rotatably mounted on one side of a bench support for leg exercise. The angular relationship between the lever arm and resistance arm is adjustable, and dead weights are used to provide resistance to forward rotational movement.

Fulks U.S. Pat. No. 4,854,578 also discloses a multi-purpose exercise machine which employs a lever arm and a resistance arm that rotate around a common horizontal pivot axis. Resistance to rotational movement is provided by dead weights, and the lever arm and resistance arm may be biased toward either forward or rearward rotation by insertion of a stop pin into one of a plurality of stop holes as can be appreciated with reference to FIG. 1 of the patent drawings. However, this change in the rotational bias requires removal and relocation of both the lever arm and the stop pin.

Another interesting multi-function exercise device is disclosed in Wilson U.S. Pat. No. 4,072,309 which utilizes elastic bands for resistance and a variation of which is presently being sold under the trademark SOLOFLEX. This device is fundamentally different from the Fulks and the Noland et al. devices in that it does not use a resistance arm. The device utilizes a rotatably and removably mounted lever arm which is adapted to be vertically adjusted by securement of the lever arm at a desired pivot point along the length of a vertical rail. Two pins are used to support the elastic bands: an arm resistance pin, which is rigidly attached to the lever arm; and a frame resistance pin, which is removably attached to the vertical rail once secured to a pivot point, the lever arm is selectively biased for either upward or downward arcuate motion against the resistance of elastic bands by selective placement of the frame resistance pin at a location on the vertical rail beneath or above, respectively, the pivot point of the lever arm. Thus, a change in the bias of the lever arm requires removal and replacement of the lever arm, the frame resistance pin, and the associated elastic bands. These required actions are the key limitations in this type of machine which have been overcome by the novel apparatus of applicant's invention.

other similar exercise machines utilizing elastic bands are sold under the trademark CHAIRMAN (distributed by DP Fitness Products) and FLEX 110 (distributed by Welder Fitness), but both machines suffer similar shortcomings to the SOLOFLEX machine: multiple, or multiple-position, frame resistance pins; required removal of the elastic bands when changing the rotational bias of the lever arm; and the necessity of separate mechanisms to accommodate upper and lower body exercises.

Thus, applicant believes that the multi-function exercise apparatus of the present invention fills a long-felt need for an elegantly simple home use exercise apparatus employing elastic bands for resistance, and which provides the following unique features:

1. Two independently biased lever arms.
2. A highly adjustable seat and back which allows the single set of lever arms to accommodate both upper and lower body exercises.
3. Each lever arm pivots around a fixed pivot rod and does not require vertically raising or lowering of the arm during adjustment to accommodate different size users, or to accommodate the required motions for various exercises.
4. A single fixed-position frame resistance pin is used to engage one end of elastic bands for each lever arm, and removal thereof from the frame during adjustment of the lever arm from forward to rearward bias is not required.

Applicant provides a novel multi-function elastic-band exercise machine wherein (1) the user is able to adjust the angle of the lever arms as well as the forward or rearward bias thereof without removing the lever arms, the associated resistance pins, or the elastic bands from the apparatus as well as (2) allowing for working of the left and right sides of the body independently and simultaneously in a wide variety of exercises without the necessity for attachments or auxiliary equipment, and (3) making it possible to exercise both the upper body and lower body using a single set of lever arms.

DISCLOSURE OF THE INVENTION

In accordance with the present invention, applicant provides a multi-function exercise apparatus of the type utilizing elastic bands and comprising a base frame including two spaced-apart and generally upwardly extending support members. An adjustable support means is associated with the frame for supporting a user in a plurality of different upright and horizontal exercise positions.

The apparatus further includes a lever arm mounted to each of the two support members wherein each of the lever arms is pivotably mounted on a fixed shaft extending outwardly from its respective support member. An elastic band biasing means is cooperatively associated with each lever arm and its respective support member for independently biasing each of the lever arms for rotation either forward or rearward vis-a-vis the adjustable support means, and each elastic band biasing means is adapted to have its respective bias changed without requiring removal and relocation of its associated elastic band(s).

It is therefore the object of the present invention to provide an improved multi-function exercise apparatus which eliminates the need to remove and relocate the lever arms, the associated elastic band resistance pins, or the elastic bands in order to adjust the angle of the lever arm or the forward or rearward bias thereof.

It is another object of the present invention to provide a multi-function exercise apparatus which provides for independent and simultaneous exercise of the user's right and left limbs during exercise.

It is another object of the present invention to provide a multi-function exercise apparatus which provides for executing a wide variety of exercises safely on a singular machine without requiring attachments or additional equipment.

It is yet another object of the present invention to provide a multi-function exercise apparatus which is uncommonly simple in design and yet more versatile and easy to use than any multi-purpose exercise apparatus known heretofore.

It is still another object of the present invention to provide a multi-function exercise apparatus which accommodates both upper and lower body exercises using a single set of lever arms.

Some of the objects of the invention having been stated, other objects will become evident as the description proceeds, when taken in connection with the accompanying drawings described below.

BEST MODE FOR CARRYING OUT THE INVENTION

Figure 1:
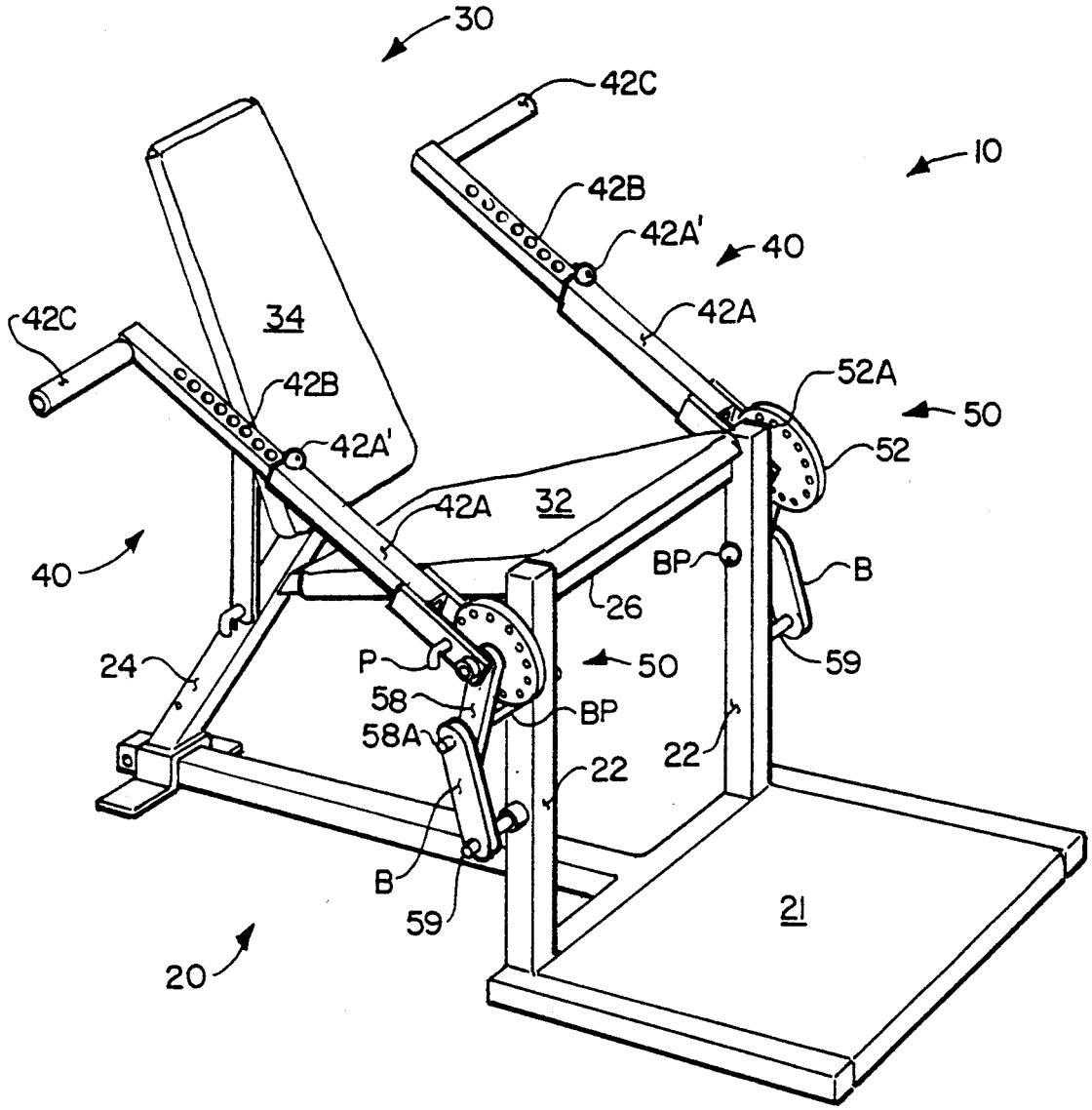
FIG. 1 is a perspective view of a multi-function exercise apparatus embodying the invention.
Figure 2:
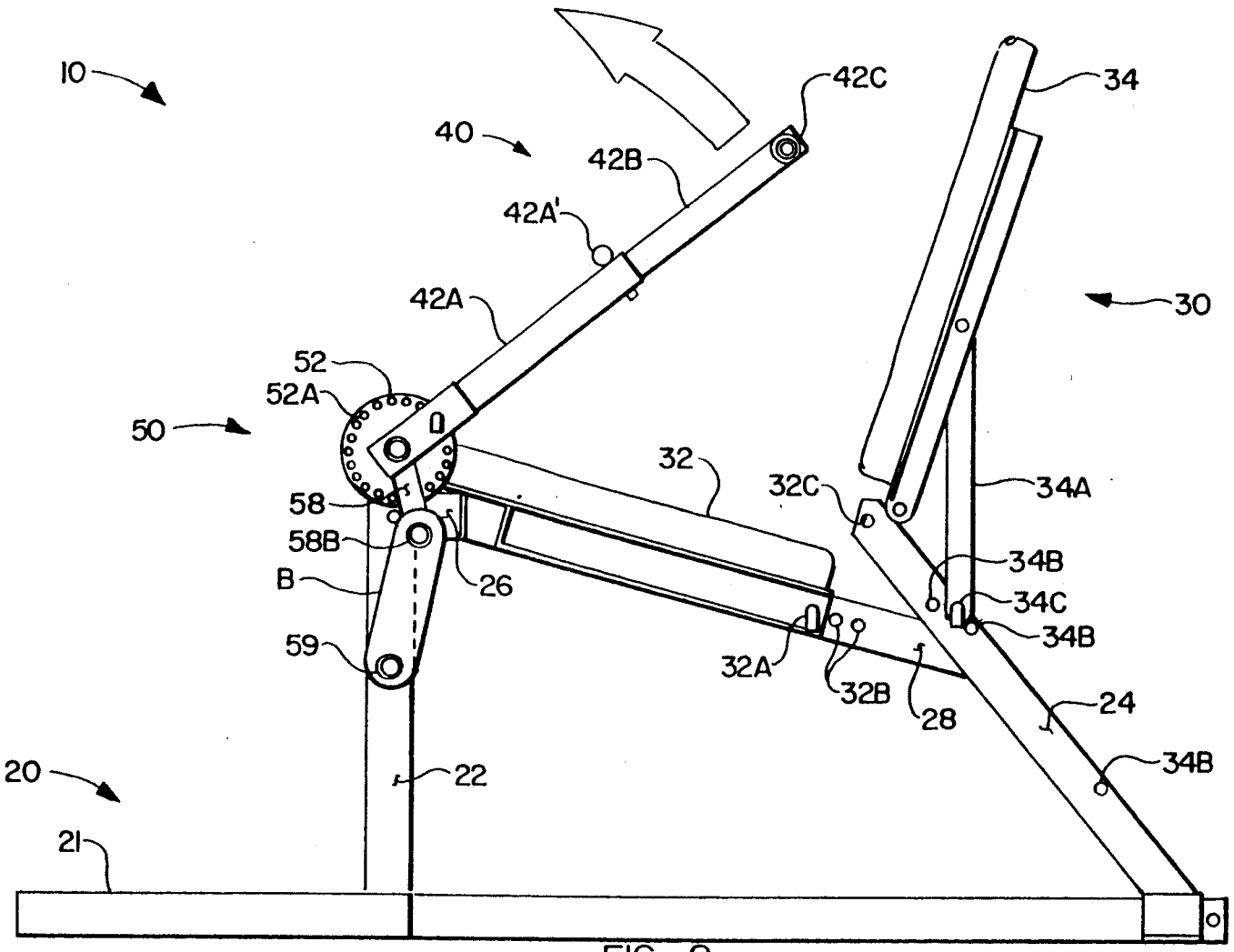
FIG. 2 is a side elevation view of the exercise apparatus in the push resistance exercise mode.
Figure 3:
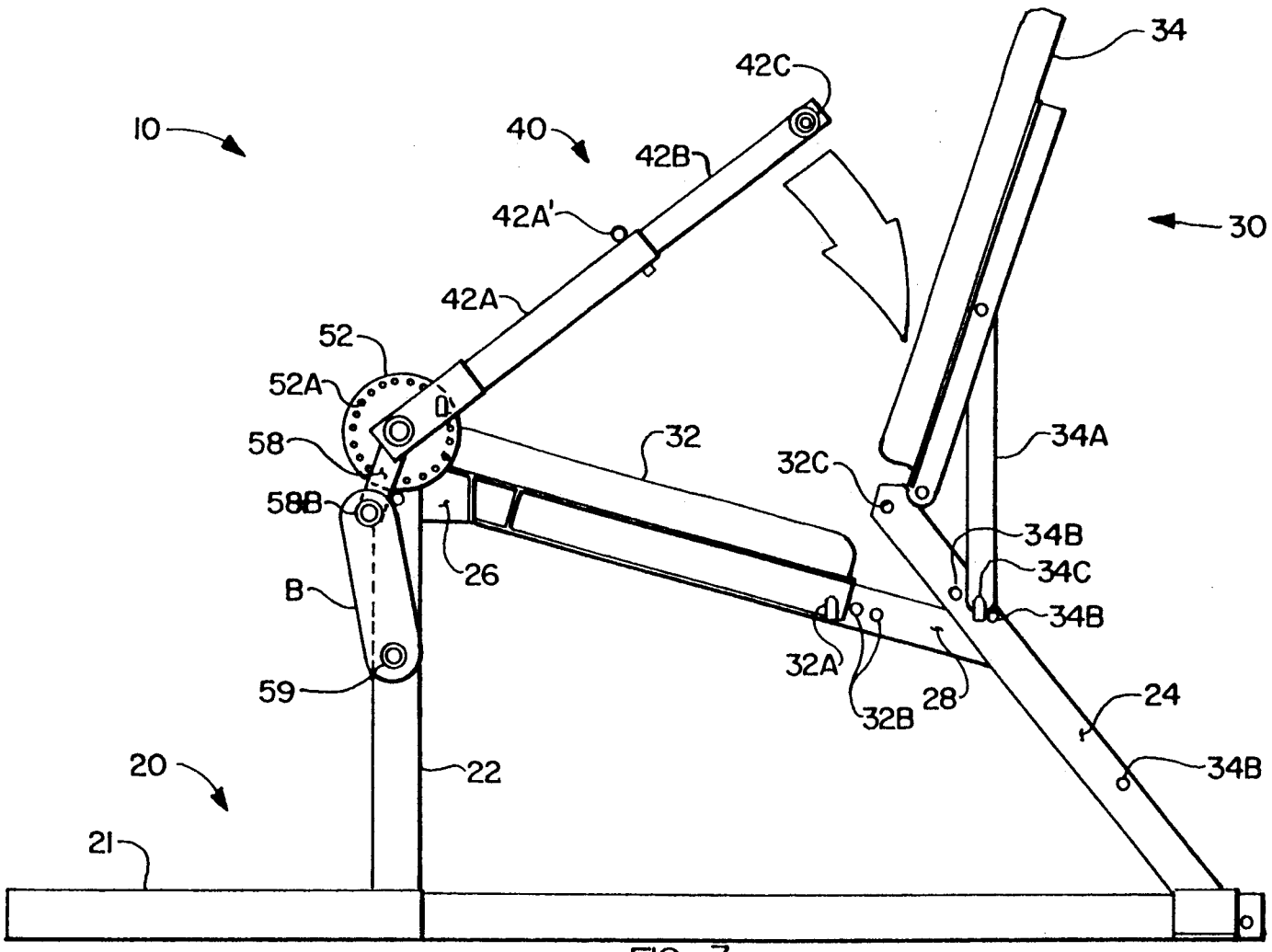
FIG. 3 is a side elevation view of the exercise apparatus in the pull resistance exercise mode.

Referring now to FIGS. 1-7 of the drawings, the multi-function exercise apparatus of the invention is generally designated 10. Apparatus 10 comprises a frame 20 (which includes platform 21 upon which the user can stand, kneel, sit, etc.) that supports an adjustable bench 30. Two independent lever arms 40 are pivotably mounted to frame 20, and a respective elastic band biasing mechanism 50 is associated with each respective lever arm 40. A detailed description of the structure of apparatus 10 will now be set forth below.

Frame 20 comprises two vertical supports 22, each of which has a pivot shaft 22A (see FIG. 4) extending outwardly from the top thereof. A third vertical support 24 is provided at the rear of frame 20, and bench 30 is supported on vertical supports 22, 24, horizontal cross support 26, and longitudinally extending cross support 28.

Bench 30 comprises two basic components, seat 32 and back 34 which may be formed from any suitable material. Seat 32 may be adjusted from an angled position (see FIGS. 2 and 3) to a horizontal position by removing seat pin 32A from apertures 32A' (not shown as aperture 32A' is hidden by pin 32A) and 32B and lifting the rear of seat 32 so that aperture 32A' (not shown as aperture 32:' is hidden by pin 32A) thereof aligns with the apertures 32C at the top of rear vertical support 24 and then reinserting seat pin 32A into the aligned apertures. Alternatively, seat 32 may be removed and used in a ground-supported position at the rear of apparatus 10 or in a ground-and-platform-supported position at the front of apparatus 10.

The angle of back 34 may be adjusted with support arm 34A, the top end of which is pivotably mounted to back 34 and the bottom end of which is adapted for securement to one of a plurality of apertures 34B along the length of rear vertical support 24 by removing retractable pin 34C therefrom, repositioning support arm 34A so as to align the apertures in the bottom thereof with a selected set of apertures 34B in vertical support 24 and then reinserting retractable pin 34C through the aligned apertures. Furthermore, back 34 can be lowered to a position parallel with frame member 24.

Lever arms 40 are formed from telescopically adjustable sections 42A, 42B secured together by pin 42A' and are provided with outwardly extending handles 42C at the upper end thereof. Sections 42B may be oriented so that handles 42C are oriented outward, inward, forward or rearward. Lever arms 40 are each pivotably mounted to respective pivot shaft 22A provided at the top of each front vertical support 22 (see FIG. 4). This mounting can be accomplished by any suitable means including providing apertures 43A' at the bottom of sections 42A of lever arms 40. The position of lever arms 40 vis-a-vis bench 30 can be adjusted in a simple fashion which does not require the removal of lever arms, arm and/or frame resistance pins, or elastic bands by means of the elastic band biasing mechanism So which will now be described in detail.

With particular reference to FIGS. 2-5, elastic band biasing mechanism So can be seen to comprise a circular disc 52 having a plurality of apertures 52A located circumferentially around the perimeter of the disc. A collar 54 is provided in the center of disc 52, and lever arm 40 and disc 52 are both mounted on pivot shaft 22A by inserting the shaft through apertures 43A' of lever arm 40 and collar 54 of disc 52. Suitable washers and/or bushings S6 are used to secure lever arm 40 and disc 52 to pivot shaft 22A. As can be appreciated from the drawings, particularly FIGS. 4–5, lever arm 40 can pivot about pivot shaft 22A independently of disc 52 rotatably mounted thereon. A fixed resistance arm 58 extends radially outwardly from collar 54 and beyond the periphery of disc 52. An arm resistance pin 58A is provided at the outer end of resistance arm 58 for receiving the upper end of an elastic band (or plurality of bands) B which are slidably mounted thereon. A complementary fixed frame resistance pin 59 is provided on vertical support 22 for receiving the other end of elastic band B thereon.

Figure 4:
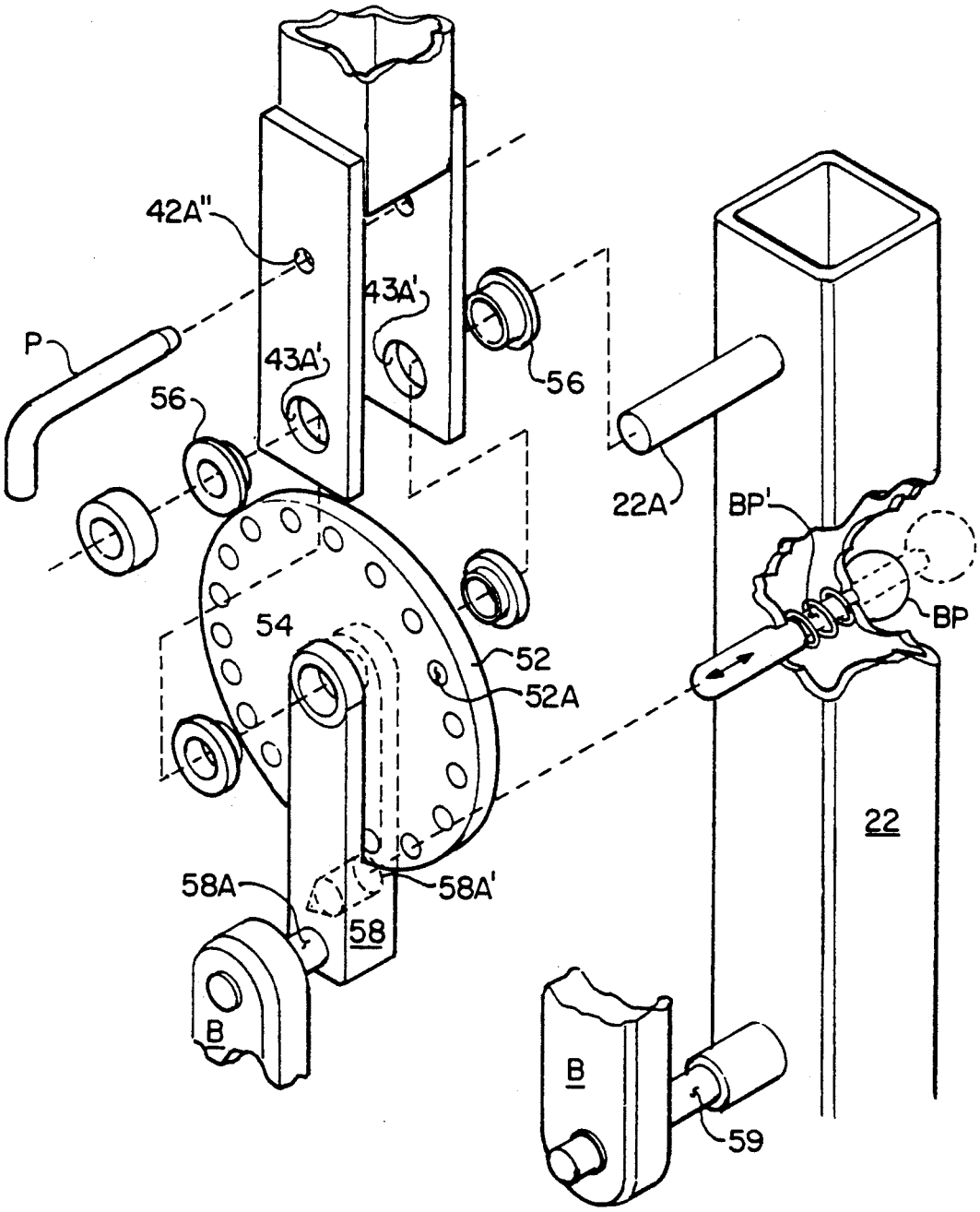
FIG. 4 is an enlarged and exploded perspective view, with parts broken away for clarity, of the elastic band biasing means of the exercise apparatus.
Figure 5C:
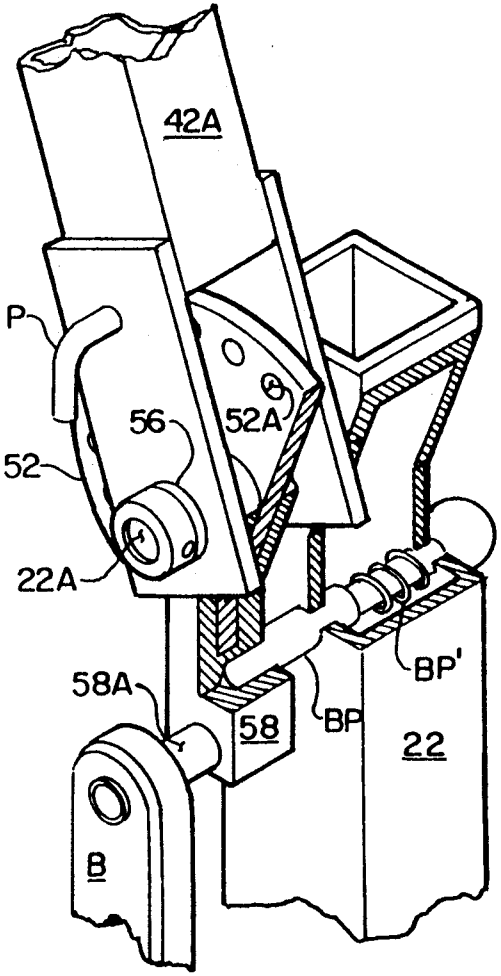
FIG. 5C is an enlarged fragmentary perspective view of the elastic band biasing means shown in FIG. 4 locked for slidably removing and/or receiving elastic bands.

Still referring to FIGS. 4–5 and elastic band biasing mechanism 50, it can further be seen that a retractable lever arm pin P is provided which may be removably and selectively positioned through apertures 42A" of lever arm section 42A and a selected aperture 52A of disc 52 in order to select and fix the angle between lever arm 40 and resistance arm 58. This adjustment allows for the relative adjustment of lever arm 40 vis-a-vis bench 30 to accommodate both different sized users and/or the performance of different exercises on apparatus 10.

Figure 5B:
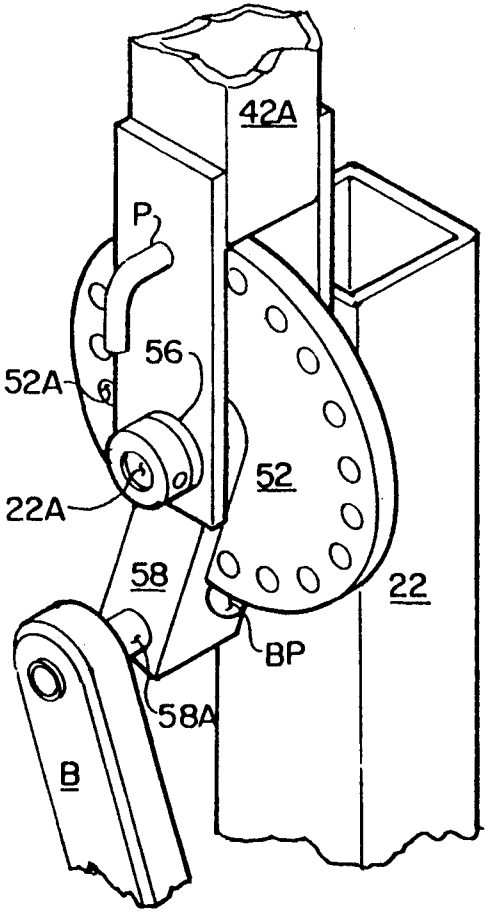
FIG. 5B is an enlarged fragmentary perspective view of the elastic band biasing means shown in FIG. 4 in the pull resistance exercise mode.
Figure 5A:
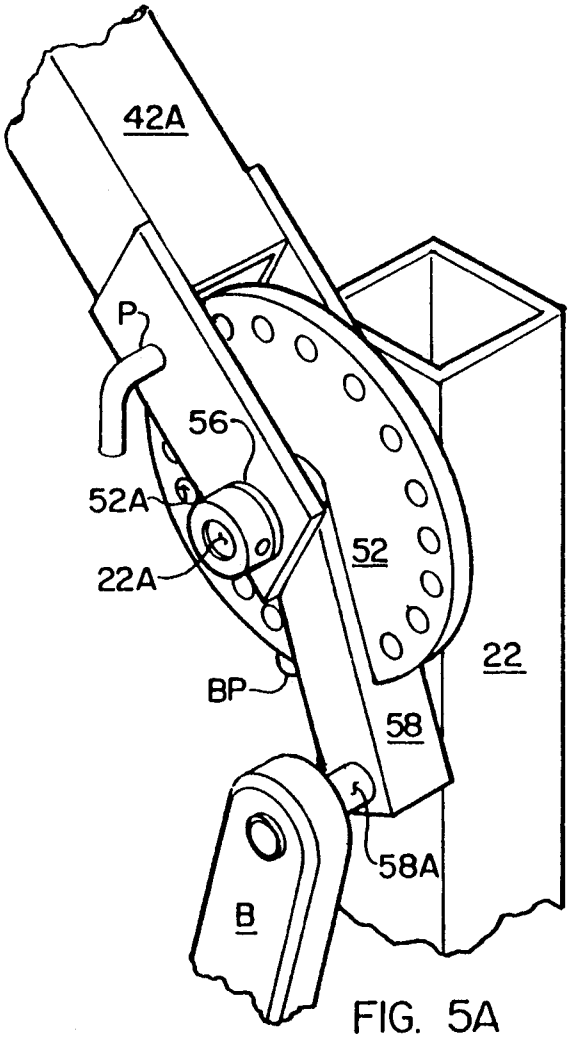
FIG. 5A is an enlarged fragmentary perspective view of the elastic band biasing means shown in FIG. 4 in the push resistance exercise mode.
Figure 6:
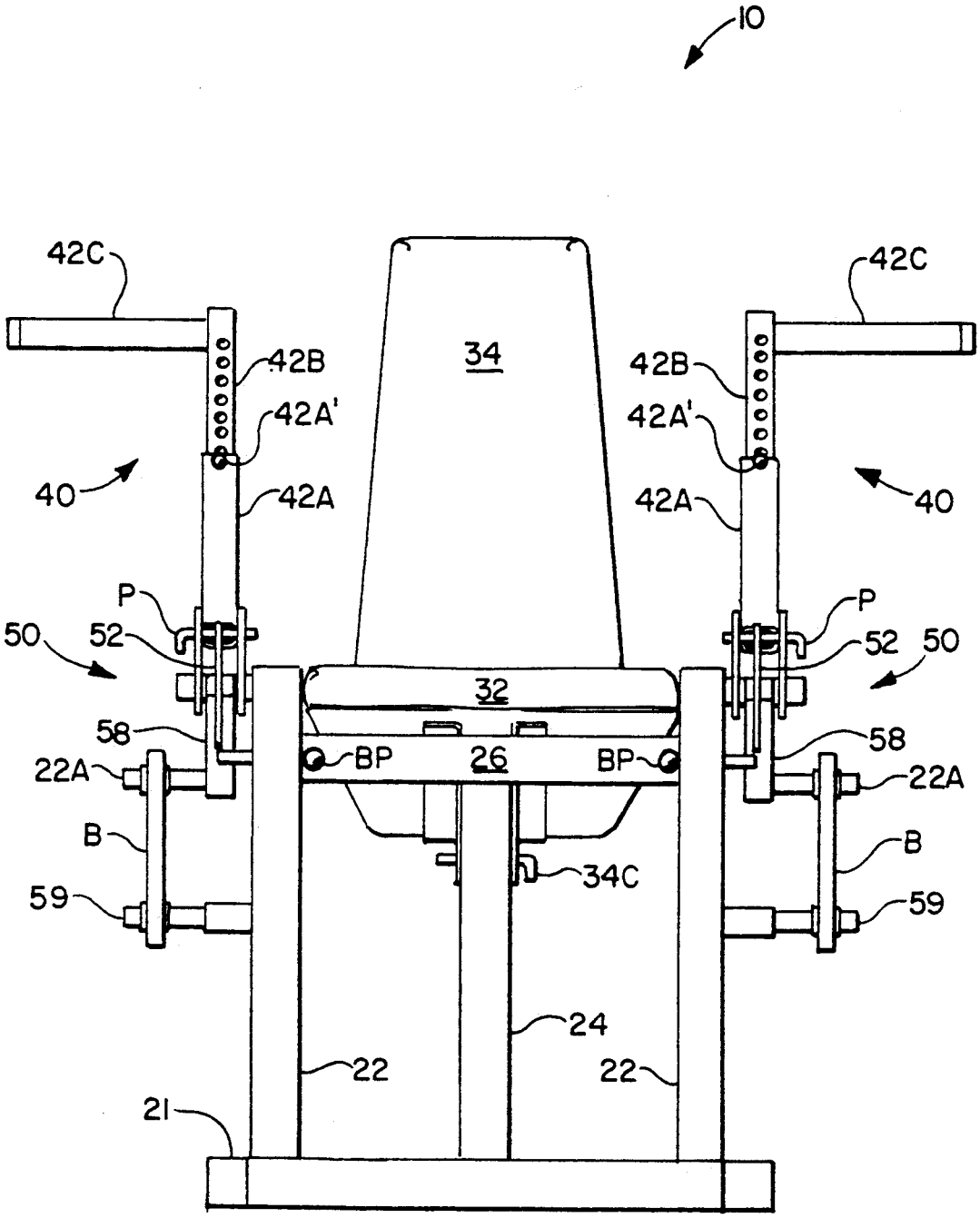
FIG. 6 is a front elevation view of the exercise apparatus.
Figure 7:
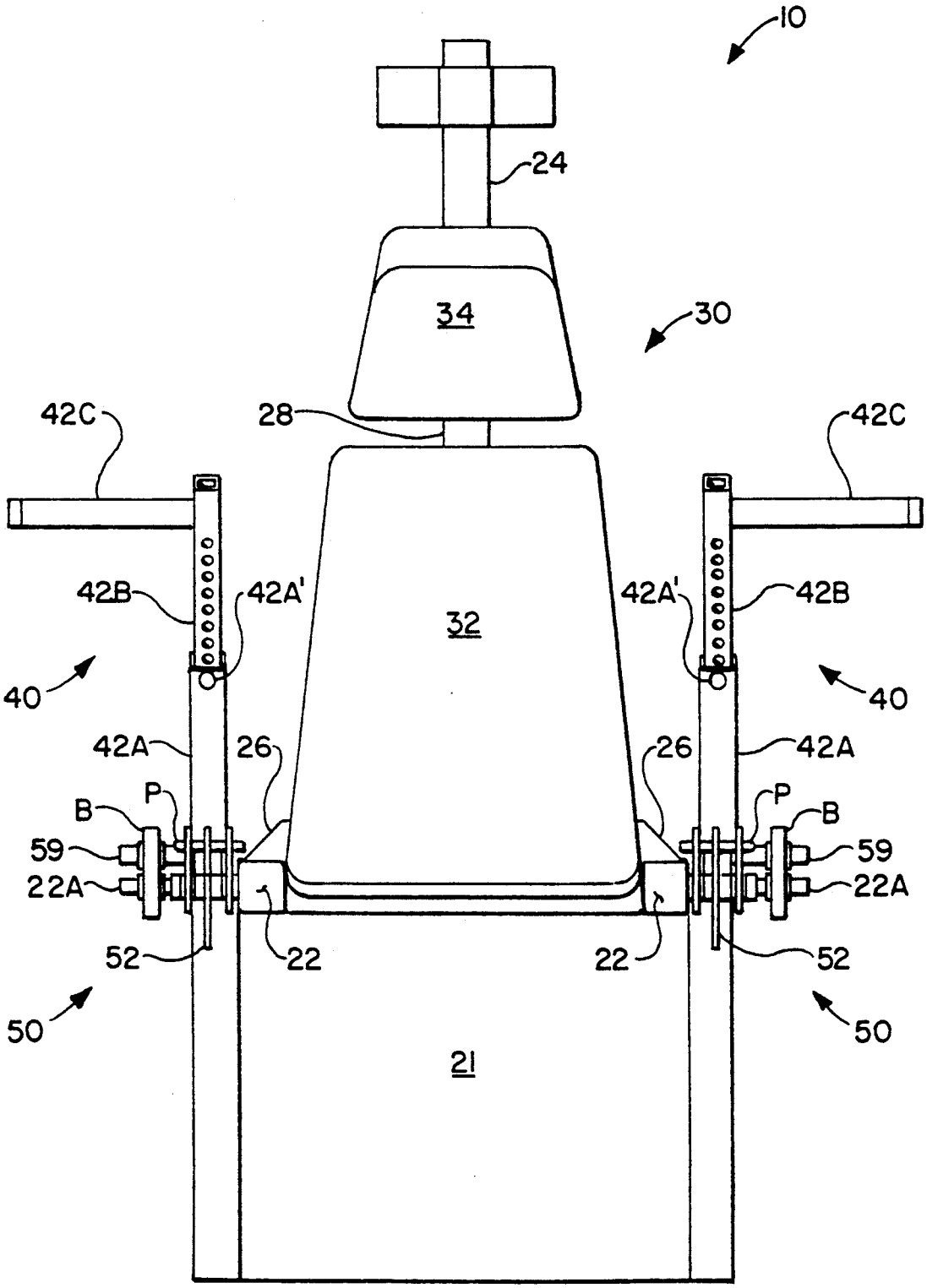
FIG. 7 is a top plan view of the exercise apparatus.

Finally, a retractable biasing pin BP is provided in an aperture in the upper portion of vertical support 22 and positioned so as to extend through vertical support 22 and into the arc defined by movement of the portion of resistance arm 58 extending beyond the periphery of disc 52 (see FIGS. 5A and 5B). Biasing pin BP is normally urged outwardly into the pathway of movement of resistance arm 58 by biasing spring BP' associated therewith (see FIG. 4).

It can now be appreciated that as the user either pushes or pulls lever arm 40, elastic band biasing mechanism 50 rotates either forwardly or rearwardly. During this motion, arm resistance pin 58A is pivoted away from frame resistance pin 59 (see FIGS. 5A and 5B) so as to stretch elastic band B and provide progressive resistance to movement. Moreover, each elastic band biasing mechanism 50 shown in FIGS. 4–5 is provided with a respective lever arm 40 on each side of apparatus 10 so as to provide for independent and simultaneous exercise of different body limbs.

Each elastic band biasing mechanism 50 permits resistance arm 58 extending from disc 52 to be selectively placed into three distinct positions. First of all, in the "load" position, resistance arm 58 is in a vertically downwardly depending position so as to bring arm resistance pin 58A and frame resistance pin 59 into closest proximity and thereby allow the user to slide onto the pins one or more bands B. In this position, biasing pin BP has been inserted into an aperture 58A' provided on the inside face of resistance arm 58 to prevent any movement of elastic band biasing mechanism 50. The remaining two positions are best defined as "rest" positions that determine the range of motion of resistance arm 58. One position permits rotation only toward the front of apparatus 10 (see FIG. 3 and FIG. 5B) and the other position permits rotation only toward the rear of apparatus 10 (see FIG. 2 and FIG. 5A). Biasing pin BP also serves as a safety stop in the event that the user releases handle 42C during a pushing or pulling motion.

The rest position required for a given exercise depends on the necessary action against lever arms 40 (e.g., pushing or pulling) and the location of the user. When resistance arms 58 are biased for forward rotation, the rear faces of resistance arms 58 rest on biasing pins BP, and when biased for rearward rotation the front faces of resistance arms 58 rest on biasing pins BP.

In the rest positions, each resistance arm 58 is set about 16° forward or rearward of a vertical line which would extend from the rotational axis of disc 52 to main frame resistance pin 59 positioned therebeneath on vertical support 22. To switch rest positions, a user would retract biasing pin BP and rotate resistance arm 58 about 32° to bring resistance arm 58 to the other rest position. At this point, the user would release biasing pin BP so that it again restricts rotation of resistance arm 58 to one direction. Thus, the novel elastic band biasing mechanism 50 allows both the direction of rotation as well as the position of lever arms 40 to be adjusted without removing lever arms 40 or resistance pins SSA and 59 associated with each lever arm for removably receiving one or more elastic bands B thereon. Furthermore, both of these adjustments can be made without removing the elastic bands.

Each rest position also serves another important function: it increases the distance between resistance pins 58A and frame resistance pins 59. This action stretches the elastic band slightly, thereby taking out its initial slack. Thus, the user encounters resistance immediately when beginning a pushing or pulling motion.

In use, a user would make any of the following adjustments to the left and/or right side elastic band biasing mechanism So of apparatus 10 that are necessary for a given exercise:

1. With the biasing mechanism in the "load" position, adjust the amount of resistance by placing one or more bands B into place.
2. Set the rotational bias by retracting biasing pin BP, rotating resistance arm 58 to the appropriate "rest" position, and then releasing biasing pin BP.
3. Rotate lever arm 40 into position and lock it to associated disc 52 using lever arm pin P.
4. Adjust the position and orientation of handle 42C.
5. Adjust the position of seat 32 and/or back 34 of bench 30.

Once the setup described above has been accomplished (which should take about 1 to 2 minutes), apparatus 10 would permit a large number of exercises, including the following:

EXERCISES

CHEST: bench press, inclined bench press, pushdown, dips, straight arm pull-over, straight arm raise, one-arm butterfly.

ARMS: biceps curl, triceps pushdown, triceps press, forearm curl, reverse forearm curl, rotator cuff.

SHOULDERS AND NECK: military press, press behind neck, rear deltoid raise, front deltoid raise, shrugs, upright rowing.

LEGS: rear extension, thigh extension, leg raise, hamstring curl, abduction, adduction, calf raise, hack squat.

BACK: dead lift, hyperextension, seated rowing, lat pull-down, bent-over rowing, good morning stretch, side lat adduction.

ABDOMINALS: sit ups, crunches, Roman chair, abdominal extension, side bend.

It should be appreciated that any type of spring means, such as a helical spring, may be used as the biasing means of the instant invention in lieu of elastic bands and thus the invention is not intended to be limited solely to the use of elastic bands in the biasing means thereof.

It will be understood that various details of the invention may be changed without departing from the scope of the invention. Furthermore, the foregoing description is for the purpose of illustration only, and not for the purpose of limitation—the invention being defined by the claims.

What is claimed is:

1. A multi-function exercise apparatus of the type utilizing elastic bands comprising:

a base frame including two spaced-apart generally upwardly extending support members;

an adjustable support means associated with said frame for supporting a user in a plurality of different upright and horizontal exercise positions;

a lever arm mounted to each of said two support members wherein each of said lever arms is pivotably mounted on a fixed shaft extending from its respective support member; and elastic band biasing means cooperatively associated with each of said lever arms and its respective support member and comprising an elastic band for independently resiliently biasing each of said lever arms either forward or rearward vis-a-vis said adjustable support means, said elastic band biasing means each being adapted to have its resilient bias changed without requiring removal and relocation of said elastic band, said elastic band biasing means each comprising:

a disc rotatably mounted on said fixed shaft of said corresponding support member so as to be rotatably movable relative to said respective lever arm pivotably mounted thereon, said disc defining a plurality of apertures around the periphery thereof and having a fixed arm extending radially outwardly therefrom with a first engagement element at the remote end thereof for engaging one end of the elastic band;

a second engagement element fixedly secured to said corresponding support member and spaced-apart from said disc for engaging the other end of the elastic band;

an aperture provided in the lower end of said lever arm so as to individually register with a plurality of said disc apertures as said lever arm is pivotably adjusted relative to said disc, and a pin element for slidable placement through said lever arm aperture and a selected disc aperture to provide a desired fixed angular orientation between said lever arm and said fixed arm of said disc; and an outwardly biased and inwardly deflectable stop element mounted to said corresponding support member adjacent said disc and within the arc defined by pivotal movement of said fixed arm of said disc, whereby said fixed arm may be selectively placed on opposing sides of said stop element by deflecting said stop element beneath the arc movement of said fixed arm for selective adjustment of said lever arm for movement either forward or rearward visa-vis said adjustable support means.

2. An exercise apparatus according to claim 1 wherein said base frame includes a third support member spaced-apart from said two support members and said support means is adjustably secured to the top portion of said first, second and third support members.

3. An exercise apparatus according to claim 2 wherein said adjustable support means comprises a seat member and a back support member.

4. An exercise apparatus according to claim 1, wherein said lever arms each has a handle and each comprises a plurality of telescopically adjustable sections to provide for slidably adjusting the lever arms lengthwise and for adjusting the orientation of the handles.

5. An exercise apparatus according to claim 1 wherein said stop element comprises a retractable biasing pin.

6. A multi-function exercise apparatus comprising:

a base frame including two spaced-apart generally upwardly extending support members;

an adjustable support means associated with said frame for supporting a user in a plurality of different upright and horizontal exercise positions;

a lever arm mounted to each of said two support members wherein each of said lever arms is pivotably mounted on a fixed shaft extending from its respective support member; and resilient biasing means cooperatively associated with each of said lever arms and its respective support member and comprising at least one resilient biasing element for independently resiliently biasing each of said lever arms either forward or rearward vis-a-vis said adjustable support means, said resilient basing means each being adapted to have its resilient bias changed without requiring removal and relocation of said resilient biasing element, wherein said resilient biasing element comprise an elastic band, and wherein each of said elastic band biasing means comprises:

a disc rotatably mounted on said fixed shaft of said corresponding support member so as to be rotatably movable relative to said respective lever arm pivotably mounted thereon, said disc defining a plurality of apertures around the periphery thereof and having a fixed arm extending radially outwardly therefrom with a first engagement element at the remote end thereof for engaging one end of the elastic band;

a second engagement element fixedly secured to said corresponding support member and spaced-apart from said disc for engaging the other end of the elastic band;

an aperture provide din the lower end of said lever arm so as to register individually with a plurality of said disc apertures as said lever arm is pivotably adjusted relative to said disc, and a pin element for slidable placement through said lever arm aperture and a selected disc aperture to provide a desired fixed angular orientation between said layer arm and said fixed arm of said disc; and an outwardly biased and inwardly deflectable stop element mounted to said corresponding support member adjacent said disc and within the arc defined by pivotal movement of said fixed arm of said disc, whereby said fixed arm may be selectively placed on opposing sides of said stop element by deflecting said stop element beneath the arc movement of said fixed arm for selective adjustment of said lever arm for rotation either forward or rearward vis-a-vis said adjustable support means.

7. A multi-function exercise apparatus comprising:

a base frame including two spaced-apart generally upwardly extending support members;

a support means associated with said frame for supporting a user in a plurality of different exercise positions;

a lever arm mounted to each of said two support members wherein each of said lever arms is pivotally mounted on a fixed shaft extending from its respective support member; and resilient biasing means cooperatively associated with each of said lever arms and its respective support member and comprising at least one resilient biasing element for independently resiliently biasing each of said lever arms either forward or rearward vis-a-vis said adjustable support means, said resilient biasing means each being adapted to have its resilient bias changed without requiring removal and relocation of said resilient biasing element, wherein said resilient biasing element comprises an element selected from the group consisting of a spring and an elastic band, sand wherein each of said resilient biasing means comprises:

a disc rotatably mounted on said fixed shaft of said corresponding support member so as to be rotatably movable relative to said respective lever arm pivotably mounted thereon, said disc defining a plurality of apertures around the periphery thereof and having a fixed arm extending radially outwardly therefrom with a first engagement element at the remote and thereof for engaging one end of the resilient biasing element;

a second engagement element fixedly secured to said corresponding support member and spaced-apart from said disc for engaging the other end of the resilient biasing element;

an aperture provide din the lower end of said lever arm so as to register individually with a plurality of said disc apertures as said lever arm is pivotably adjusted relative to said disc, and an engagement element for slidable placement through said lever arm aperture and a selected disc aperture to provide a desired fixed angular orientation between said lever arm and said fixed arm of said disc; and a stop element mounted to said corresponding support member adjacent said disc and within the arc defined by pivotal movement of said fixed arm of said disc, whereby said fixed arm may be selectively placed on opposing sides of said stop element by deflecting said stop element beneath the arc movement of said fixed arm for selective adjustment of said lever arm for rotation either forward or rearward vis-a-vis said adjustable support means.

* * * * *

UNITED STATES PATENT AND TRADEMARK OFFICE

CERTIFICATE OF CORRECTION

PATENT NO. : 5,277,684

DATED : January 11, 1994

INVENTOR(S) : Robert Harris

It is certified that error appears in the above-identified patent and that said Letters Patent is hereby corrected as shown below:

Column 1, line 30, "machine other" should "machine. Other"
Column 2, line 11, "rail once" should be "rail. Once"
line 23, "other" should be "Other"

Column 4, line 60, "So" should be "50"
line 63, "So" should be "50"

Column 5, line 2, "S6" should be "56"

Column 6, line 18, "SSA" should be "58A"

Column 7, line 62, "visa-vis" should be "vis-a-vis"

Column 8, line 48, "provide din" should be "provided in"

Column 9, line 21, "sand" should be "and"

UNITED STATES PATENT AND TRADEMARK OFFICE

CERTIFICATE OF CORRECTION

PATENT NO. : 5,277,684

DATED : January 11, 1994

INVENTOR(S) : Robert Harris

It is certified that error appears in the above-indentified patent and that said Letters Patent is hereby corrected as shown below:

Column 10, line 8, "provide din" should be "provided in".

Signed and Sealed this

Third Day of January, 1995

*Attest:*

*Attesting Officer*

BRUCE LEHMAN

*Commissioner of Patents and Trademarks*